US007411347B2

(12) United States Patent
Hur et al.

(10) Patent No.: US 7,411,347 B2
(45) Date of Patent: Aug. 12, 2008

(54) PLASMA DISPLAY PANEL

(75) Inventors: Min Hur, Suwon-si (KR); Takahisa Mizuta, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 459 days.

(21) Appl. No.: 11/272,083

(22) Filed: Nov. 14, 2005

(65) Prior Publication Data

US 2006/0103311 A1 May 18, 2006

(30) Foreign Application Priority Data

Nov. 15, 2004 (KR) ..... 10-2004-0093070

(51) Int. Cl.
*H01J 17/49* (2006.01)

(52) U.S. Cl. ..... 313/582; 313/584

(58) Field of Classification Search ..... 313/582–586
See application file for complete search history.

(56) References Cited

U.S. PATENT DOCUMENTS 6,172,461 B1 * 1/2001 Ha ..... 313/585
6,380,678 B1 * 4/2002 Kim ..... 313/586
6,445,120 B1 * 9/2002 Kim et al. ..... 313/491

FOREIGN PATENT DOCUMENTS

| | | |
|---|---|---|
| JP | 04-229931 | 8/1992 |
| JP | 06-084467 | 3/1994 |
| JP | 08-045433 | 2/1996 |
| KR | 10-1994-0007245 | 8/1994 |
| KR | 10-0297682 | 5/2001 |

* cited by examiner

*Primary Examiner*—Vip Patel
(74) *Attorney, Agent, or Firm*—H.C. Park & Associates, PLC

(57) ABSTRACT

A plasma display panel includes a first substrate, and a second substrate provided opposing the first substrate and defining a plurality of discharge cells between the first and second substrates. Phosphor layers are respectively formed in the discharge cells. Address electrodes are formed along a first direction on the first substrate, and first and second electrodes are formed adjacent to the first substrate and separated from the address electrodes. The first and second electrodes extend along a second direction that intersects the first direction, and the first and second electrodes are provided corresponding to each of the discharge cells. The first and second electrodes are formed extended in a direction away from the first substrate and toward the second substrate, and opposing each other with a spacing provided therebetween. The first and second electrodes include protrusions that extend toward centers of the discharge cells.

20 Claims, 8 Drawing Sheets

PLASMA DISPLAY PANEL

CROSS REFERENCE TO RELATED APPLICATIONS

This application claims priority to and the benefit of Korean Patent Application No. 10-2004-0093070, filed on Nov. 15, 2004 in the Korean Intellectual Property Office, the entire content of which is incorporated herein by reference.

BACKGROUND OF THE INVENTION

1. Field of the Invention

The present invention relates to a plasma display panel (PDP), and more particularly to a PDP that enhances illumination efficiency while reducing a discharge firing voltage.

2. Description of Related Art

One type of PDP is the triode surface-discharge PDP. The triode surface-discharge PDP includes a first substrate having an inner surface on which there are formed sustain electrodes and scan electrodes, and a second substrate opposing the first substrate with a predetermined gap therebetween and having an inner surface on which there are formed address electrodes. The first and second substrates are sealed together in a state where discharge gas is provided therebetween. Discharge of the PDP is affected by operation of the scan electrodes and the address electrodes, which are connected to each line and independently controlled. Sustain discharge is realized by the sustain electrodes and the scan electrodes.

The PDP utilizes glow discharge to generate visible light. Subsequent to the generation of glow discharge, the PDP undergoes a predetermined process before users can view images formed by the PDP. In particular, with the generation of glow discharge, gas plasma is generated that is excited by the collision of atoms with the gas, after which ultraviolet (UV) rays are emitted from the gas. The UV rays collide with phosphors in discharge cells such that the phosphors emit visible light. This visible light passes through the first substrate for users to view. During this process, however, significant loss of input power applied to the sustain electrodes and scan electrodes occurs.

This glow discharge occurs by applying between two electrodes a high voltage that exceeds the discharge firing voltage. Hence, a relatively high voltage is needed to initiate discharge. If discharge occurs, voltage distribution is distorted between cathodes and anodes as a result of a space charge effect, which is generated on the dielectric layer in the vicinity of cathodes and anodes. Formed between two electrodes are a cathode sheath region, which is located in the periphery of cathodes and wherein most of the voltage applied to two electrodes to effect discharge is consumed, an anode sheath region, which is located in the periphery of anodes and wherein part of the voltage is consumed, and a positive column region, which is located between the other two regions and wherein almost no voltage is consumed. In the cathode sheath region, electron heating efficiency is present in a secondary electron coefficient of an MgO protection layer formed on a surface of a dielectric layer, and in the positive column region, most of the input energy is consumed in electron heating.

Vacuum UV rays that emit visible light by colliding with phosphors are generated as xenon (Xe) gas changes from an excitation state to a ground state. The excitation state of xenon (Xe) occurs by collision between xenon (Xe) gas and electrons. Accordingly, to increase the amount of visible light generated relative to the input energy (i.e., illumination efficiency), electron heating efficiency must be raised to thereby increase collisions between xenon (Xe) gas and electrons.

In the cathode sheath region, although most of the input energy is consumed, the electron heating efficiency is low. In the positive column region, the electron heating efficiency is very high, even though the consumption of input energy is low. Accordingly, a high illumination efficiency is possible by increasing the positive column region (discharge gap).

Further, with respect to a ratio of electrons consumed among all electrons according to variations in a ratio (E/n) between an electric field (E) formed in the discharge gap (positive column region) and a gas density (n), in the same ratio (E/n), the electron consumption ratio increases in the sequence of xenon excitation (Xe*), xenon ions (Xe+), neon excitation (Ne*), and neon ions (Ne+). In addition, in the same ratio (E/n), the greater the increase in a partial pressure of xenon (Xe), the more the electron energy decreases. That is, if the electron energy decreases, the partial pressure of xenon (Xe) increases, and if the partial pressure of xenon (Xe) increases, among the electrons consumed in xenon excitation (Xe*), xenon ions (Xe+), neon excitation (Ne*), and neon ions (Ne+), the ratio of electrons consumed in the excitation of xenon (Xe) compared to other areas is increased. As a result, illumination efficiency is increased.

As described above, an increase in the positive column region results in an increase in electron heating efficiency. Further, an increase in xenon (Xe) partial pressure results in increasing a heating ratio of electrons consumed for xenon excitation (Xe*). Accordingly, increasing both of these factors results in enhancing electron heating efficiency such that illumination efficiency is improved.

However, increases in the positive column region and xenon (Xe) partial pressure result in an increase in a discharge firing voltage, as well as in manufacturing costs of the PDP.

Therefore, in order to enhance illumination efficiency, it is necessary that increases in the positive column region and xenon (Xe) partial pressure be realized while maintaining a low discharge firing voltage.

As is well known, when a length and pressure of the discharge gap are identical, the discharge firing voltage required when utilizing a surface discharge structure is less than that required when using an opposing discharge structure.

SUMMARY OF THE INVENTION

In accordance with the present invention, a plasma display panel is provided that applies an opposing discharge structure to reduce a discharge firing voltage and increase an illumination efficiency.

The plasma display panel includes a first substrate; and a second substrate provided opposing the first substrate that defines a plurality of discharge cells between the first and second substrates. A plurality of phosphor layers may be respectively formed in the discharge cells. A plurality of address electrodes may be formed along a first direction on the first substrate. A plurality of first electrodes and second electrodes may be formed adjacent to the first substrate and separated from the address electrodes. The first electrodes and second electrodes may extend along a second direction that intersects the first direction, and the first and second electrodes may be provided to correspond to each of the discharge cells.

The first electrodes and second electrodes may be formed to extend in a direction away from the first substrate and toward the second substrate, and opposing each other with a spacing provided therebetween. The first electrodes and second electrodes may include protrusions that extend toward centers of the discharge cells.

DETAILED DESCRIPTION

Exemplary embodiments of the present invention will now be described with reference to the drawings.

Figure 1:
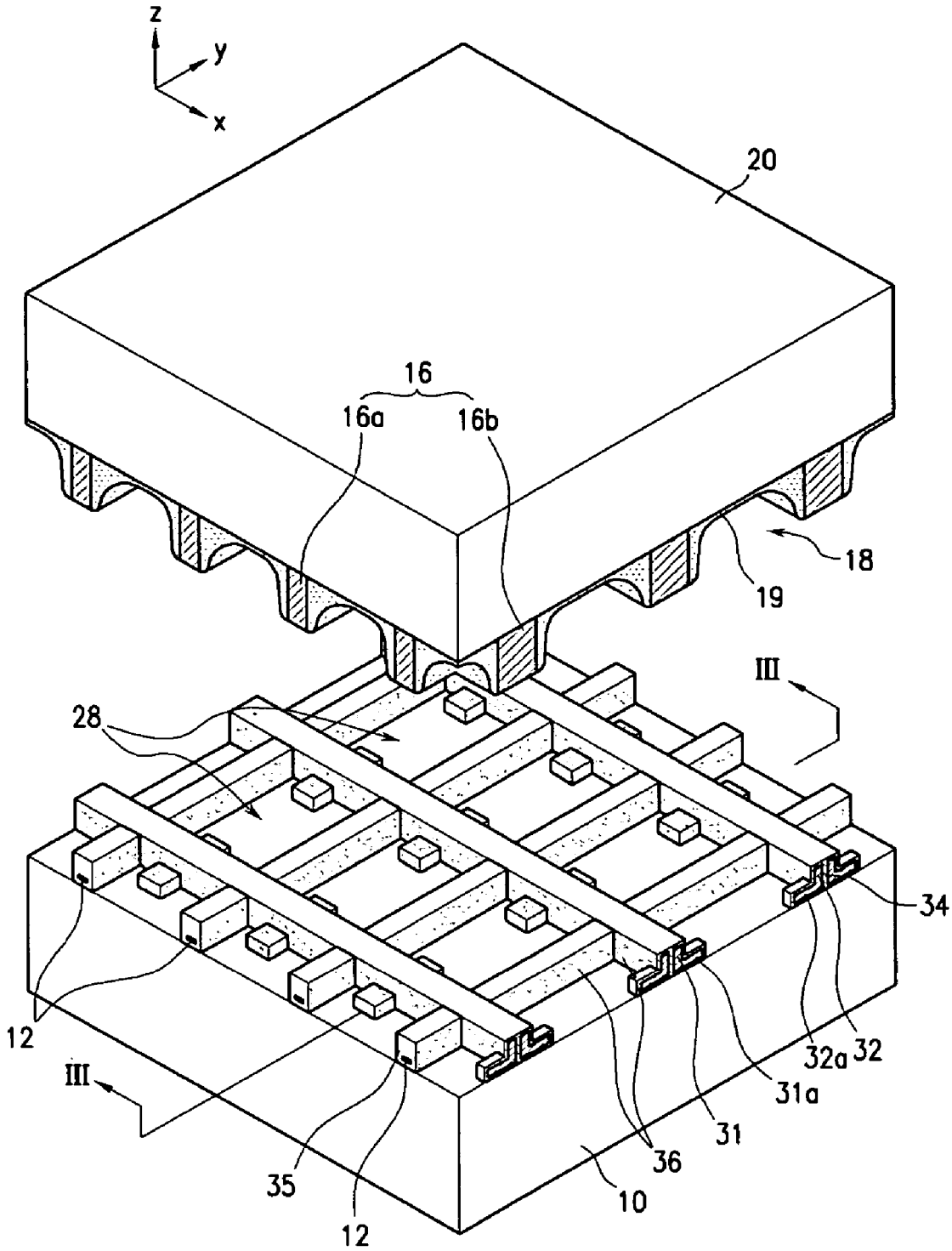
FIG. 1 is a partial exploded perspective view of a PDP according to a first exemplary embodiment of the present invention.
Figure 2:
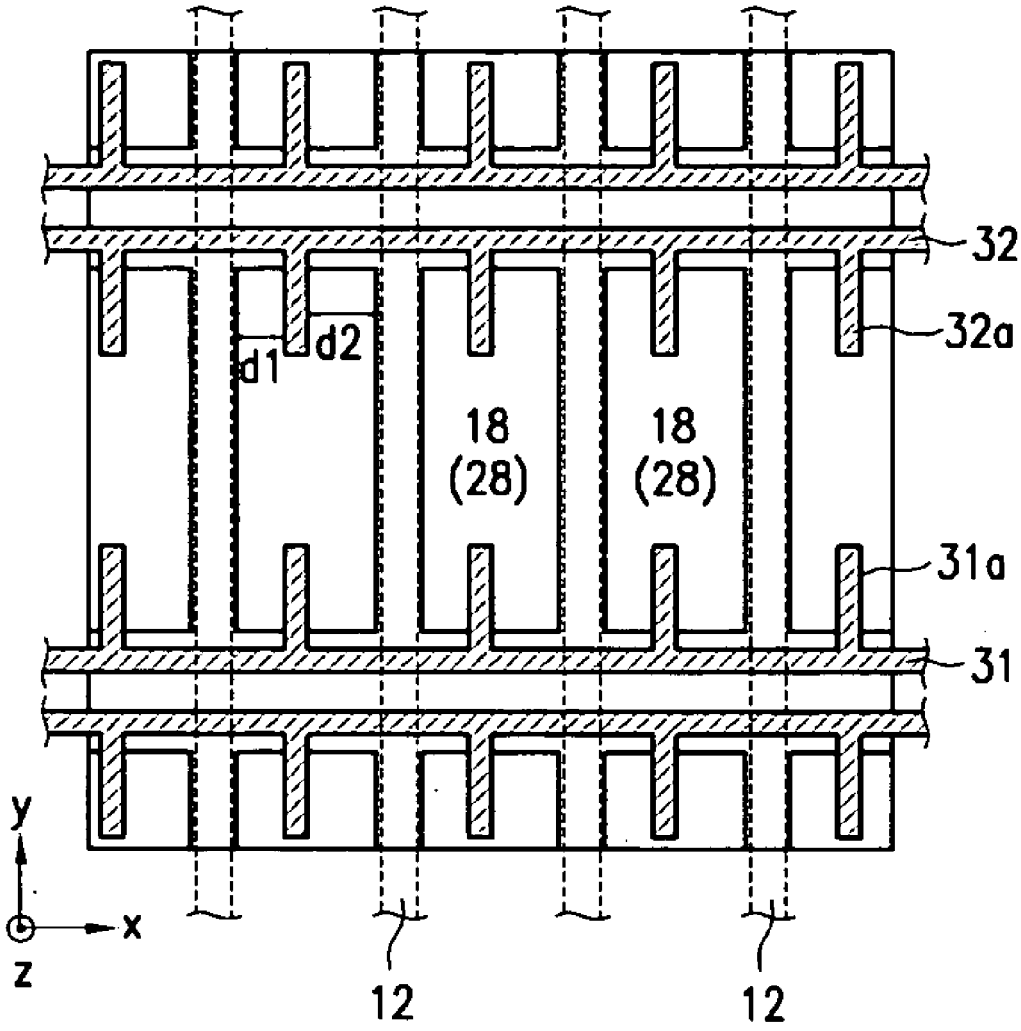
FIG. 2 is a partial plan view of the PDP of FIG. 1, illustrating a structure of electrodes and discharge cells.
Figure 3:
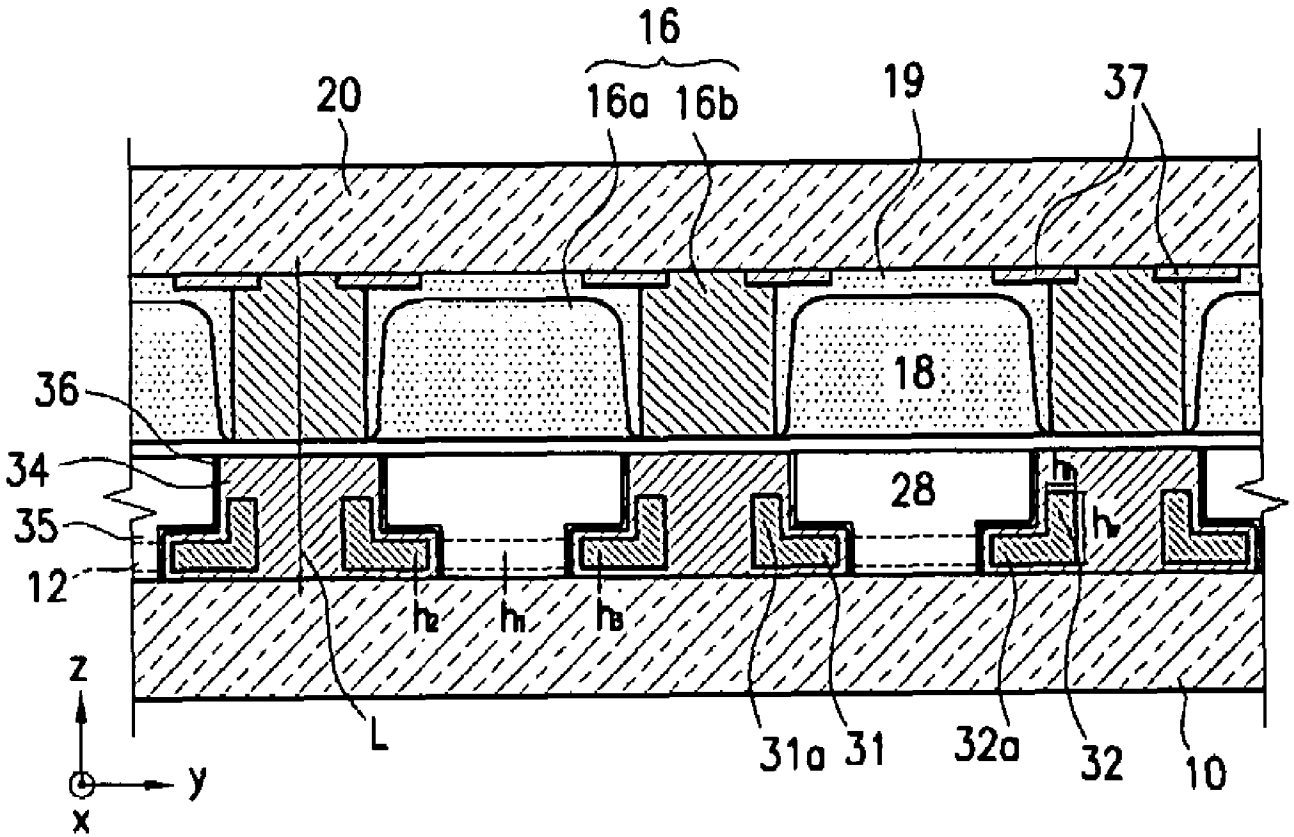
FIG. 3 is a sectional view taken along line III-III of FIG. 1 in a state where the PDP is assembled.

FIG. 1 is a partial exploded perspective view of a PDP according to a first exemplary embodiment of the present invention, FIG. 2 is a partial plan view of the PDP of FIG. 1, illustrating a structure of electrodes and discharge cells, and FIG. 3 is a sectional view taken along line III-III of FIG. 1 in a state where the PDP is assembled.

The PDP of the first exemplary embodiment of the present invention includes a first substrate (hereinafter referred to as a rear substrate) 10, a second substrate (hereinafter referred to as a front substrate) 20, and a plurality of barrier ribs 16 formed between the rear and front substrates 10, 20 defining a plurality of first discharge cells 18 in which discharge occurs. Phosphor layers 19 that absorb vacuum UV rays and emit visible light are respectively formed in the first discharge cells 18. Further, a discharge gas that generates vacuum UV rays by plasma discharge is filled in the first discharge cells 18. A compound gas containing xenon (Xe) and neon (Ne) may be used for the discharge gas.

The barrier ribs 16 are formed between the rear and front substrates 10, 20 (i.e., adjacent to the front substrate 20 and extending toward the rear substrate 10) to thereby form first discharge cells 18, which define discharge spaces adjacent to the front substrate 20. Formed on the rear substrate 10 at areas opposing the barrier ribs 16 are first electrodes (hereinafter referred to as sustain electrodes) 31, and second electrodes (hereinafter referred to as scan electrodes) 32. The sustain electrodes 31 and the scan electrodes 32 define a plurality of second discharge cells 28 that provide discharge spaces adjacent to the rear substrate 10. This configuration results in opposing pairs of the first and second discharge cells 18, 28, each pair of which cooperates to form a single discharge cell.

The discharge spaces formed by the barrier ribs 16 (ie., the first discharge cells 18) have greater volumes than that discharge spaces formed by the sustain and scan electrodes 31, 32 (i.e., the second discharge cells 28). This enhances a transmissivity of visible light, which is generated in the first and second discharge cells 18, 28, through the front substrate 10.

The barrier ribs 16 may form the first discharge cells 18 into a variety of shapes including quadrilateral and hexagonal shapes. In this embodiment, the first discharge cells 18 are quadrilateral in shape.

The barrier ribs 16 are formed on the front substrate 20 and include first barrier rib members 16*a* extended along a first direction (direction y in the drawings), and second barrier rib members 16*b* extending along a second direction (direction x in the drawings) to thereby intersect the first barrier rib members 16*a*. The first and second barrier rib members 16*a*, 16*b* form the first discharge cells 18 as independent units.

The phosphor layers 19 are respectively formed in the first discharge cells 18 as described above. In particular, the phosphor layers 19 are formed on inner walls of the first and second barrier rib members 16*a*, 16*b*, as well as on the front substrate 20 within the first discharge cells 18. The phosphor layers 19 are formed on the front substrate 20 in this manner such that visible light is generated at the front substrate 20 and passes therethrough, thereby enhancing illumination efficiency.

The phosphor layers 19 may be formed by depositing phosphor material on the front substrate 20 following formation of the barrier ribs 16. Alternatively, a dielectric layer may be selectively formed on the front substrate 20, after which the barrier ribs 16 are formed and phosphor material deposited on the dielectric layer. In yet another possible method, after the front substrate 20 is etched to form the first discharge cells 18 therein, phosphor material is deposited on the front substrate 20 to form the phosphor layers 19. In this last example, this results in the barrier ribs 16 and the front substrate 20 being made of the same material.

Following sustain discharge, the phosphor layers 19 absorb vacuum UV rays in the first discharge cells such that visible light directed toward the front substrate 20 is generated.

In order to create images by the generation of vacuum UV rays that will collide with the phosphor layers 19 by plasma discharge, address electrodes 12, the sustain electrodes 31, and the scan electrodes 32 are formed on the rear substrate 10 opposing the first discharge cells 18.

The address electrodes 12 are extended along direction y between the barrier ribs 16 and the rear substrate 10. That is, the address electrodes 12 are formed on the rear substrate 10 along direction y and aligned with the first barrier rib members 16*a*. The address electrodes 12 oppose the first barrier rib members 16*a*, therefore, and are uniformly mounted while maintaining a spacing corresponding to the first discharge cells 18 along direction x.

The address electrodes 12 are shared between pairs of the first and second discharge cells 18, 28 adjacent along direction x. That is, since the address electrodes 12 are provided aligned with the first barrier rib members 16*a* (or more precisely and preferably corresponding to centers of the first barrier rib members 16*a*) as shown in FIG. 2, one-half of a width (w) of each of the address electrodes 12 extends into each of an adjacent pair of the first discharge cells 18 (i.e., adjacent along direction x).

As shown in FIG. 3, the address electrodes 12 are positioned between the rear substrate 10 and the first barrier rib members 16*a*. A center line of the address electrodes 12 extending along a length thereof, and a center line of the first barrier rib members 16*a* extending along a length thereof are substantially aligned along a third direction (direction z in the drawings).

The sustain electrodes 31 and the scan electrodes 32 are positioned between the barrier ribs 16, which define the first discharge cells 18, and the rear substrate 10. The sustain electrodes 31 and the scan electrodes 32 are electrically insulated from the address electrodes 12, and are extended substantially perpendicularly intersecting the address electrodes 12. Stated differently, the sustain electrodes 31 and the scan electrodes 32 are extended between the rear substrate 10 and the second barrier rib members 16*b* along a direction parallel to the second barrier rib members 16*b*.

The sustain and scan electrodes 31, 32 are formed such that a pair of one of each is provided for each of the first and second discharge cells 18, 28. In this embodiment, the sustain and scan electrodes 31, 32 are alternatingly formed along direction y such that one of each is mounted corresponding to the location of each of the second barrier rib members 16*b*. As a result, the first and second discharge cells 18, 28 adjacent along direction y are fully separated.

Further, the sustain and scan electrodes 31, 32 are protruded toward the front substrate 20, and each pair consisting of one of each of the sustain and scan electrodes 31, 32 interposes therebetween the first and second discharge cells 18, 28.

Together with the address electrodes 12, the scan electrodes 32 act to select the first and second discharge cells 18, 28 to be activated with respect to address discharge in an address interval. The sustain and san electrodes 31, 32 act to display images with respect to is sustain discharge in a sustain interval. In particular, a sustain pulse is applied to the sustain electrodes 31 in a sustain interval. Further, a sustain pulse is applied to the scan electrodes 32 during a sustain interval, but during a scan interval, a scan pulse is applied to the scan electrodes 32. Since the sustain and scan electrodes 31, 32 can be made to operate differently according to the signal voltage applied thereto, the present invention is not limited in this respect.

The sustain and scan electrodes 31, 32 are mounted toward the rear substrate 10 between the two substrates 10, 20 in such a manner that a pair of one of each of the sustain and scan electrodes 31, 32 is provided to both sides of rows of the first and second discharge cells 18, 28 formed along direction x to thereby form an opposing discharge structure and reduce a discharge firing voltage used for sustain discharge.

To achieve the above, the sustain and scan electrodes 31, 32 are formed to both sides of the first and second discharge cells 18, 28 as described above, and respectively include protrusions 31*a*, 32*a* that extend toward centers of the first and second discharge cells 18, 28. The protrusions 31*a*, 32*a* form short gaps respectively within discharge gaps formed between the sustain and scan electrodes 31, 32. The short gaps function to reduce a discharge firing voltage at the start of sustain discharge.

Figure 4:
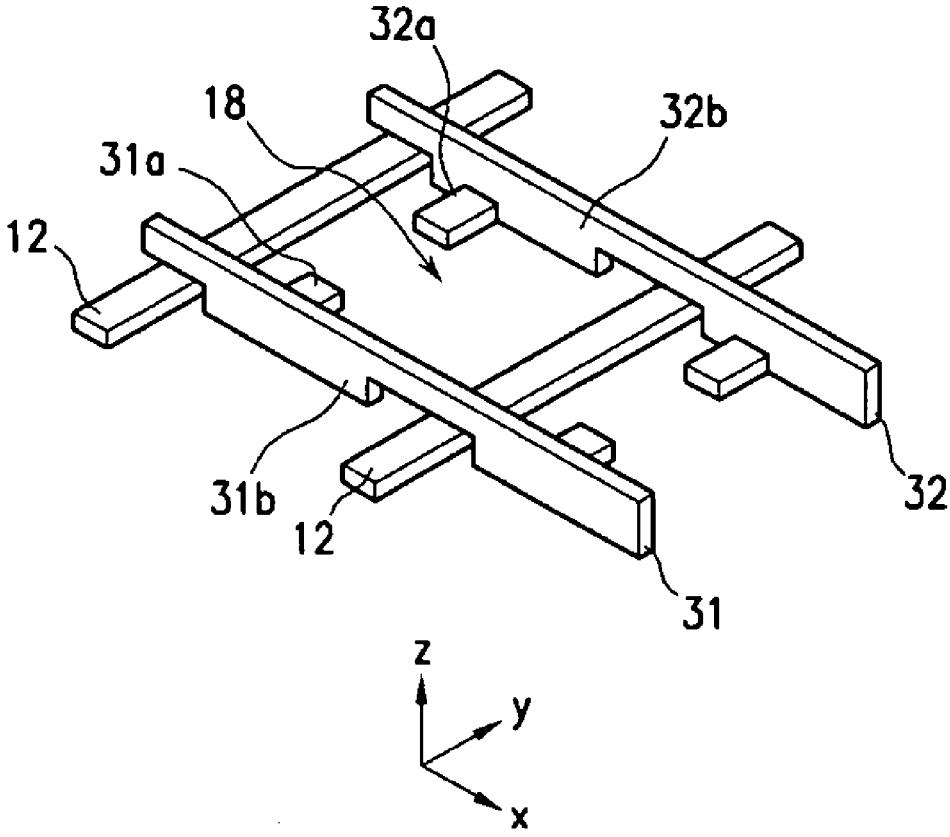
FIG. 4 is a partial perspective view of the PDP of FIG. 1, illustrating an electrode structure.

To effect an opposing discharge over a greater area, with reference also to FIG. 4, the sustain and scan electrodes 31, 32 respectively include raised sections 31*b*, 32*b* that extend in a direction perpendicular to the rear substrate 10 (i.e., along direction z) at areas corresponding to the locations of the first and second discharge cells 18, 28, as well as shortened sections formed at areas corresponding to between the first and second discharge cells 18, 28 adjacent along direction x. The raised sections 31*b*, 32*b* have a cross-sectional configuration (taken in a direction substantially perpendicular to the rear and front substrates 10, 20) with a height ($h_v$) is that is greater than a width ($h_h$). Opposing discharge formed over a large area at the raised sections 31*b*, 32*b* generates strong vacuum UV rays, which extend over the area of the first and second discharge cells 18, 28 to collide with the phosphor layers 19 and thereby increase the amount of generated visible light.

The protrusions 31*a*, 32*a* are sections where voltages applied to the sustain and 20 scan electrodes 31, 32 are applied to center areas of the first and second discharge cells 18, 28, and are preferably protruded from the raised sections 31*b*, 32*b*, which have a larger area than other sections.

The protrusions 31*a*, 32*a* may be formed to various shapes. Preferably, the protrusions 31*a*, 32*a* are angled (e.g., formed with a rectangular cross section) such that opposing discharge easily occurs at ends thereof, and opposing discharge easily occurs between the address electrodes 12 and the protrusions 32*a* of the scan electrodes 32.

With particular reference to FIG. 4, the sustain electrodes 31 and the scan electrodes 32 are formed extended and intersecting the address electrodes 12, and include the raised sections 31*b*, 32*b* that extend in a direction perpendicular to the rear and front substrates 10, 20. As a result, an intersecting configuration is created by the sustain and scan electrodes 31, 32 with the address electrodes 12, which are formed substantially as straight lines, without any interference occurring therebetween.

With reference to FIG. 3, a distance ($h_1$) between the address electrodes 12 and the rear substrate 10 is substantially the same as a distance ($h_2$) between the protrusions 31*a* of the sustain electrodes 31 and the rear substrate 10, as well as a distance ($h_3$) between the protrusions 32*a* of the scan electrodes 32 and the rear substrate. As a result, opposing discharge occurs between the address electrodes 12 and the protrusions 32*a* of the scan electrodes 32, and between the protrusions 31*a* of the sustain electrodes 31 and the protrusions 32*a* of the scan electrodes 32.

After the sustain and scan electrodes 31, 32 effect sustain discharge using the protrusions 31*a*, 32*a*, the full sustain discharge is created by the long gap between the raised sections 31*b*, 32*b*. As a result, the discharge firing voltage is reduced, and the illumination efficiency is increased.

The sustain and scan electrodes 31, 32 and the address electrodes 12 are preferably made of a metal material to increase the conductivity of these elements. The sustain and scan electrodes 31, 32 and the address electrodes 12 are covered by dielectric layers 34, 35.

The dielectric layers 34, 35 form an insulation structure between electrodes, as well as provide areas where wall charges accumulate. The sustain and scan electrodes 31, 32 and the address electrodes 12 may be manufactured using a thick film ceramic sheet (TFCS) method. That is, after separately manufacturing electrode sections that include the sustain and scan electrodes 31, 32 and the address electrodes 12, these elements are connected to the rear substrate 10 on which the barrier ribs 16 are formed.

An MgO protection layer 36 may be formed on the dielectric layers 34, 35 that cover the sustain and scan electrodes 31, 32 and the address electrodes 12. The MgO protection layer 36 may be formed at sections exposed to plasma discharge occurring within the discharge spaces in the discharge cells 18. In this embodiment, since the sustain and scan electrodes 31, 32 and the address electrodes 12 are formed on the rear substrate 10, the MgO protection layer 36 deposited on the dielectric layers 34, 35 that covers these elements may be made of an MgO material that does not allow light to pass therethrough. Compared to MgO material that does allow light to pass therethrough, such MgO material that is capable of transmitting light has a significantly higher secondary electron emission coefficient, thereby allowing for a further reduction in the discharge firing voltage.

The sustain and scan electrodes 31, 32 are formed corresponding to the second barrier rib members 16*b*, which are formed to both sides of rows of the first and second discharge cells 18, 28 arranged along direction x, and are further positioned between the second barrier rib members 16*b* and the rear substrate 10. As a result, so that a single one of the first and second discharge cells 18, 28 can be selected by an address pulse applied to the address electrodes 12, and a scan pulse applied to the scan electrodes 32, each of the protrusions 32*a* of the scan electrodes 32 is mounted closer to one of the two corresponding address electrodes 12 that flank the particular protrusion 32*a*.

That is, referring to FIG. 2, in a state where a pair of the address electrodes 12 flanks each of the protrusions 32*a* of the scan electrodes 32, each of the protrusions 32*a* maintains a distance ($d_1$) with one of the two address electrodes 12 that is less than a distance ($d_2$) with the other one of the two address electrodes 12 ($d_1<d_2$). Further, the address electrode 12 is surrounded by the dielectric layer 35 having the same dielectric constant and has the same discharge firing voltage for red (R), green (G), and blue (B). Accordingly, at the time of the address discharge, a high voltage margin can be obtained.

Figure 5:
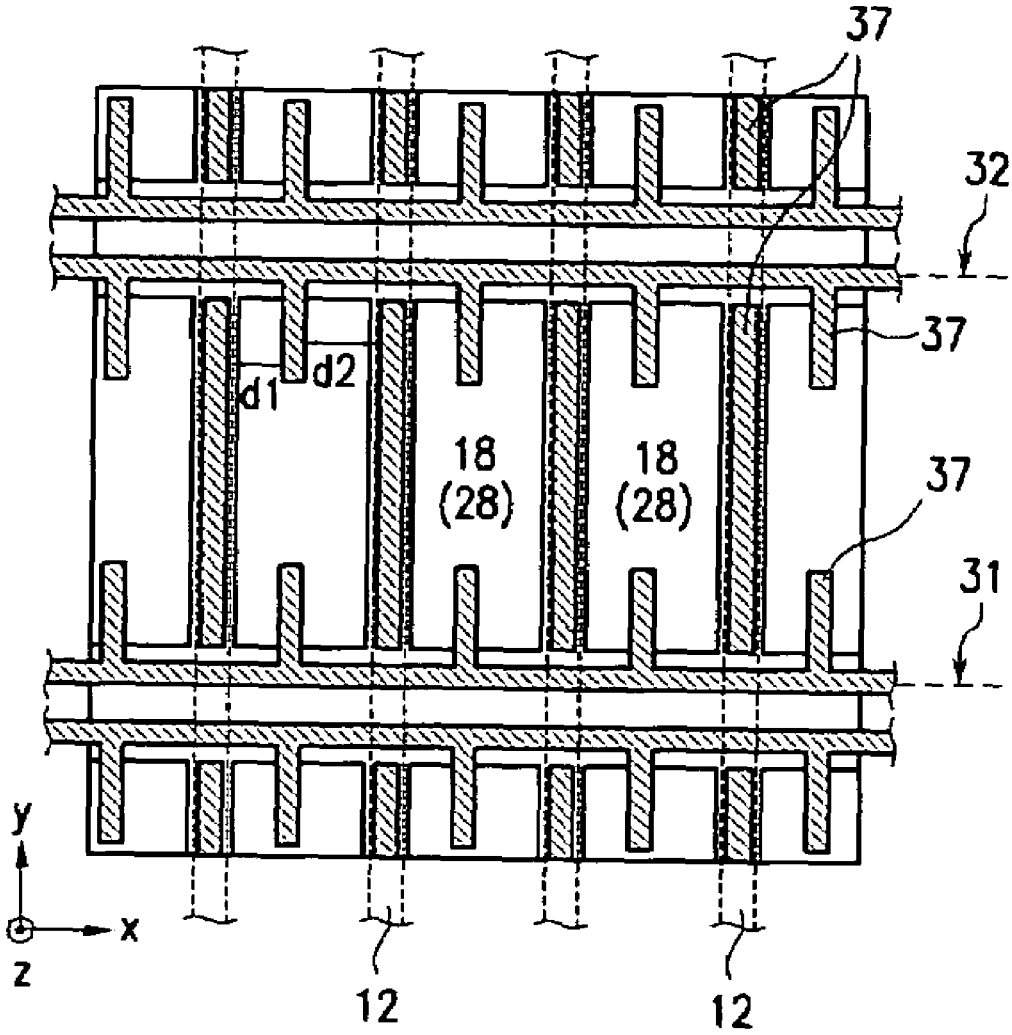
FIG. 5 a partial plan view of the PDP of FIG. 1, illustrating a relation between discharge cells and a black layer.

With reference to FIGS. 3 and 5, black layers 37 are formed on the front substrate 20 to improve contrast. After the formation of the black layers 37 on the front substrate 20, the black layers 37 are covered by the phosphor layers 19, and following the formation of the phosphor layers 19, additional black layers (not shown) may be formed on the phosphor layers 19.

The black layers 37 are preferably formed adjacent to the front substrate 20, and corresponding to the planar pattern (x-y plane) of the address electrodes 12, and the sustain and scan electrodes 31, 32. As a result, the black layers 37 absorb external light to improve contrast, and are positioned at areas where these electrodes block visible light such that the black layers 37 do not block any more light passing through the front substrate 20. The back layers 37 therefore improve illumination efficiency.

In addition, the sustain and scan electrodes 31, 32 are alternatingly provided along direction y such that a repeating arrangement of one of the sustain electrodes 31 and one of the scan electrodes 32 is realized along direction y. Therefore, provided in areas corresponding to the second barrier rib members 16*b* between adjacent rows of the first and second discharge cells 18, 28 formed along direction x are one of the scan electrodes 32 and one of the sustain electrodes 31.

Alternatively, an alternating arrangement of one of the sustain electrodes 31 and one of the scan electrodes 32, then one of the scan electrodes 32 and one of the sustain electrodes 31 may be used. With this configuration, provided in areas corresponding to the second barrier rib members 16*b* between adjacent rows of the first and second discharge cells 18, 28 formed along direction x are either two of the sustain electrodes 31 or two of the scan electrodes 32.

Various additional exemplary embodiments of the present invention will be described below. The embodiments to follow are similar to the above first exemplary embodiment. Therefore, only aspects of the additional embodiments that differ from the first will be described in the following.

Figure 6:
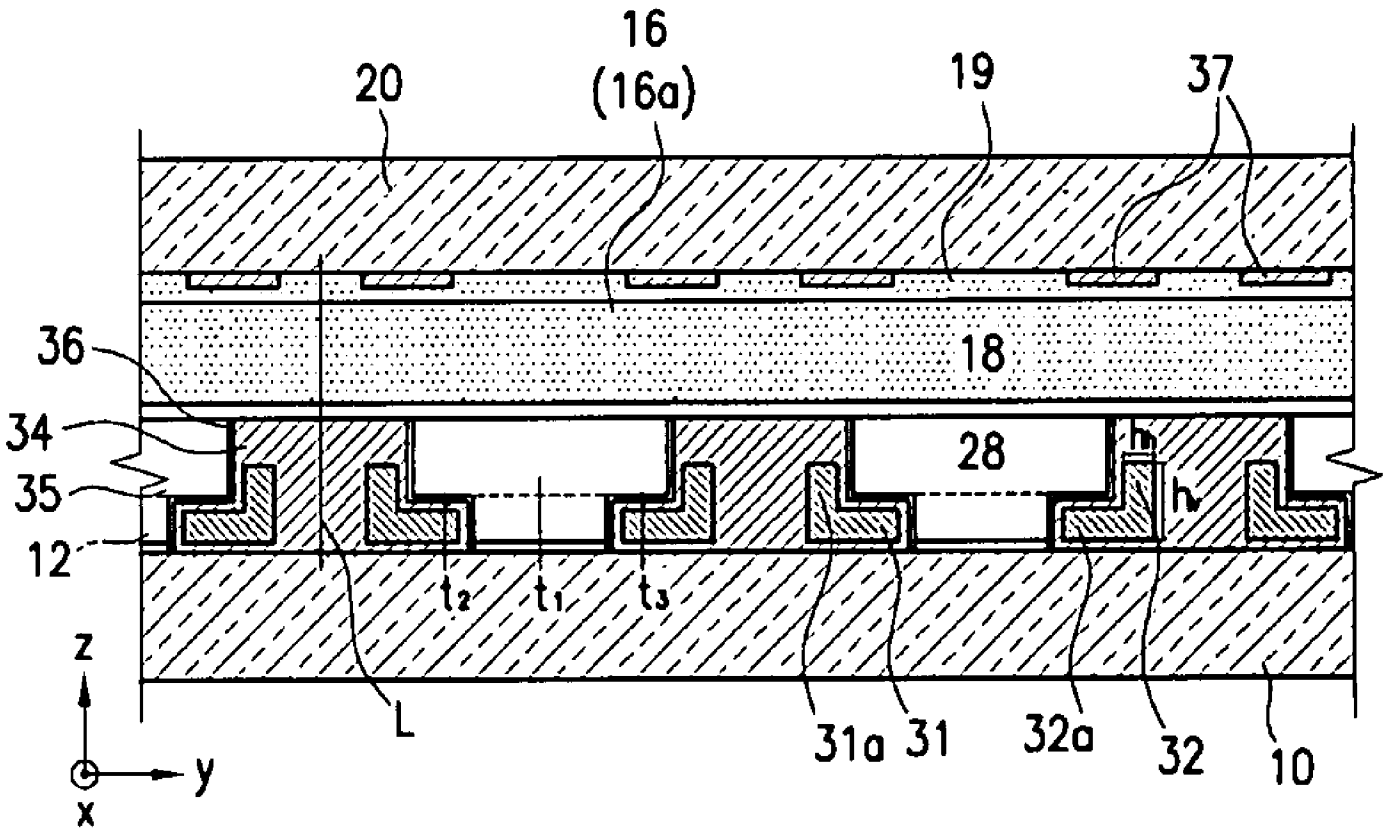
FIG. 6 is a partial sectional view of a PDP according to a second exemplary embodiment of the present invention.

FIG. 6 is a partial sectional view of a PDP according to a second exemplary embodiment of the present invention. In this embodiment, the barrier ribs 16 include first barrier rib members 16*a* formed along the same direction as the address electrodes 12, i.e., along direction y. Accordingly, the discharge cells 18 are formed in a stripe pattern, in which a plurality of the discharge cells 18 are consecutively formed in rows along direction y. A thickness ($t_1$) of the address electrodes 12 along direction z is greater than a thickness ($t_2$) of the protrusions 31*a* of the sustain electrodes 31 and a thickness ($t_3$) of the protrusions 32*a* of the scan electrodes 32. As a result, opposing discharge over a large area between the address electrodes 12 and the protrusions 32*a* of the scan electrodes 32 is possible.

Figure 7:
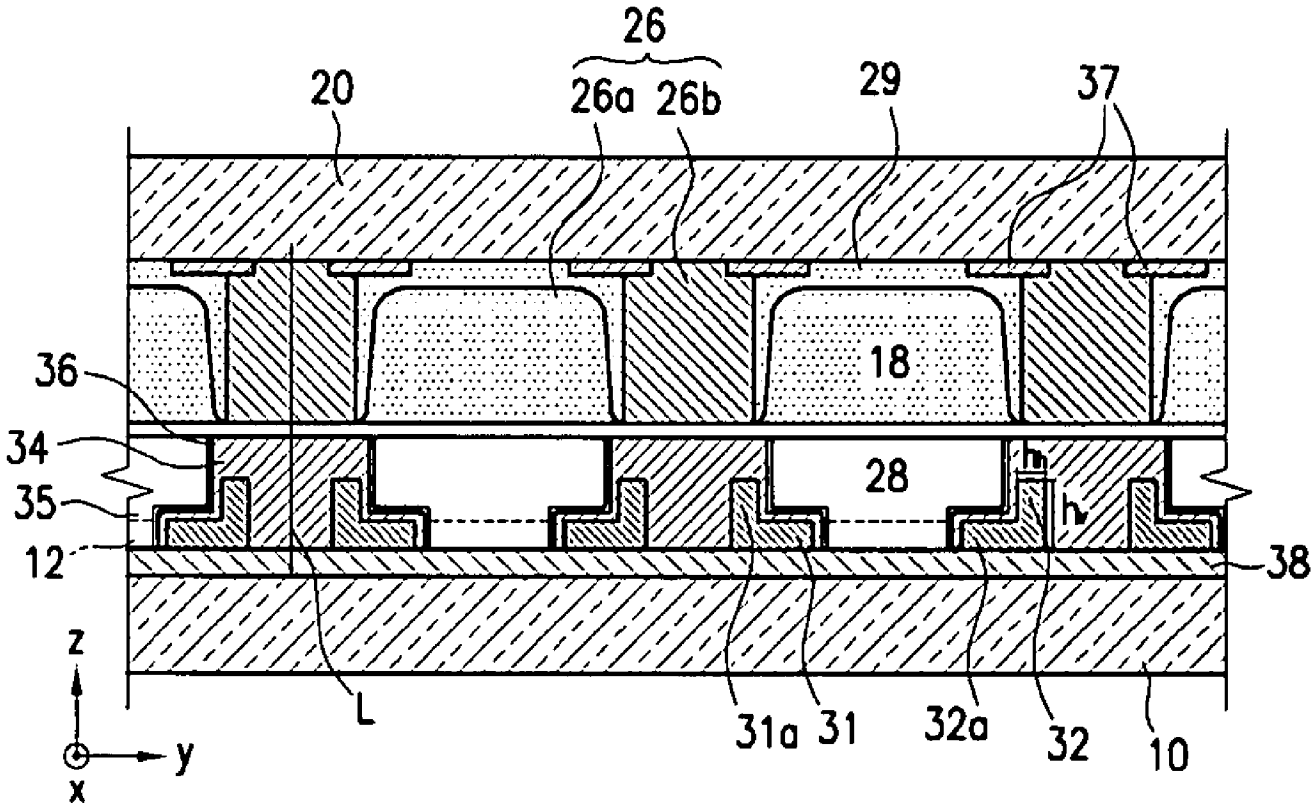
FIG. 7 is a partial sectional view of a PDP according to a third exemplary embodiment of the present invention.

FIG. 7 is a partial sectional view of a PDP according to a third exemplary embodiment of the present invention. In this embodiment, the address electrodes 12 and the sustain and scan electrodes 31, 32 are formed on a dielectric layer 38 provided on the rear substrate 10. That is, the dielectric layer 38 is formed on the rear substrate 10, and the address electrodes 12 and the sustain and scan electrodes 31, 32 are formed on the dielectric layer 38.

Figure 8:
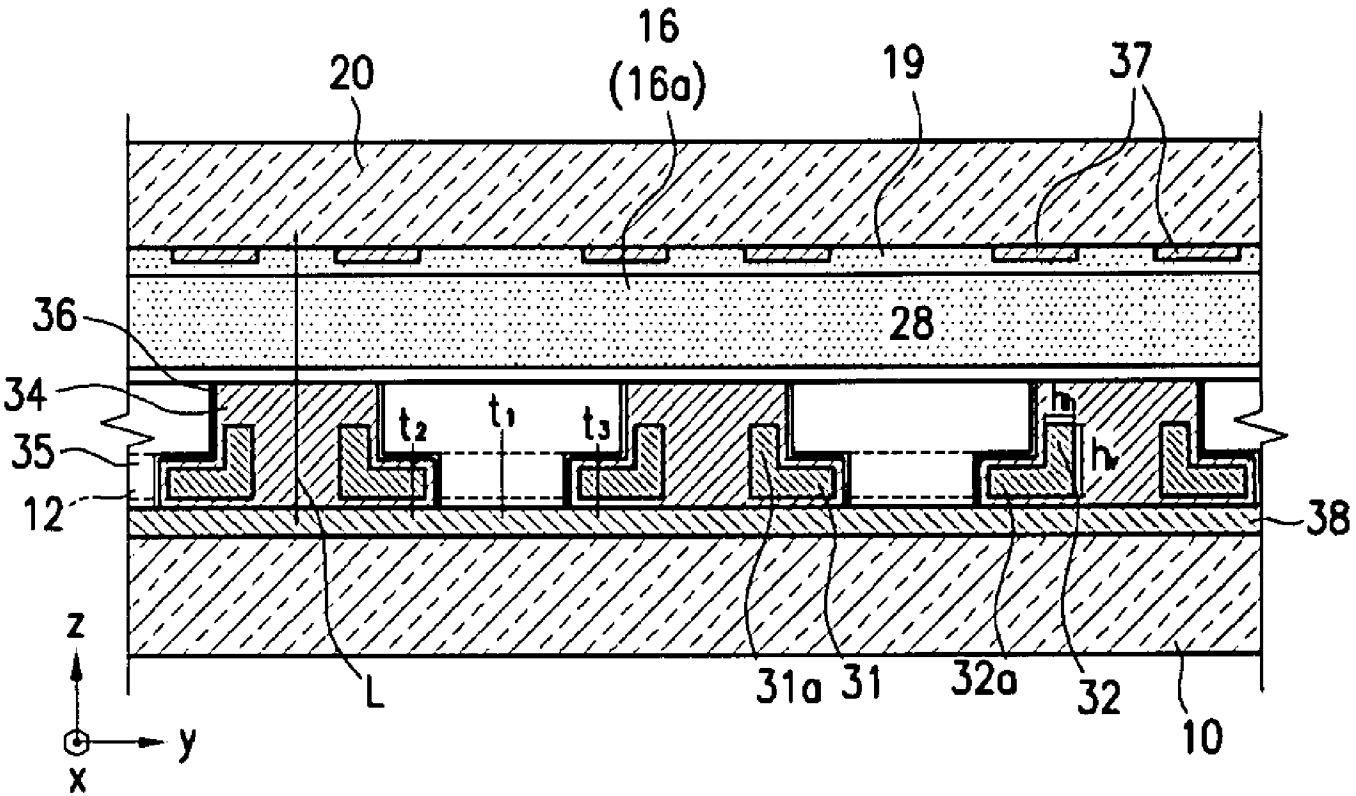
FIG. 8 is a partial sectional view of a PDP according to a fourth exemplary embodiment of the present invention.

FIG. 8 is a partial sectional view of a PDP according to a fourth exemplary embodiment of the present invention. The barrier ribs 16 include first barrier rib members 16a that are formed along direction y as in the second exemplary embodiment. Accordingly, the discharge cells 18 are formed in a stripe pattern, in which a plurality of the discharge cells 18 are consecutively formed in rows along direction y. Further, the address electrodes 12 and the sustain and scan electrodes 31, 32 are formed on a dielectric layer 38 provided on the rear substrate 10. In addition, a thickness ($t_1$) of the address electrodes 12 along direction z is greater than a thickness ($t_2$) of the protrusions 31*a* of the sustain electrodes 31 and a thickness ($t_3$) of the protrusions 32*a* of the scan electrodes 32.

In the PDP of the present invention described above, the barrier ribs are formed on the front substrate to define the discharge cells thereon, and sustain and scan electrodes, each including protrusions, are formed on the rear substrate to realize an opposing discharge structure. Short-gap discharge is effected between the sustain electrodes at an initial stage to thereby reduce the discharge firing voltage, after which long-gap discharge (opposing discharge) is effected to thereby enhance illumination efficiency.

Although embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A plasma display panel, comprising:

a first substrate;

a second substrate provided opposing the first substrate and defining a plurality of discharge cells between the first and second substrates;

a plurality of phosphor layers respectively formed in the discharge cells;

a plurality of address electrodes formed along a first direction on the first substrate; and a plurality of first electrodes and second electrodes formed adjacent to the first substrate and separated from the address electrodes, the first electrodes and second electrodes extending along a second direction that intersects the first direction, the first electrodes and second electrodes being provided corresponding to each of the discharge cells, wherein the first electrodes and second electrodes are formed extended in a direction away from the first substrate and toward the second substrate, and opposing each other with a spacing provided therebetween, wherein the first electrodes and second electrodes each comprise protrusions that extend toward a center of each the discharge cell.

2. The plasma display panel of claim 1, wherein the first electrodes and second electrodes each respectively include raised sections that extend in a direction perpendicular to the first substrate at areas corresponding to the locations of each of the discharge cells, and shortened sections formed at areas corresponding to locations between adjacent ones of a pair of the plurality of discharge cells that are adjacent along the second direction.

3. The plasma display panel of claim 2, wherein the protrusions are protruded from the raised sections.

4. The plasma display panel of claim 1, wherein each of the protrusions has a substantially rectangular cross section.

5. The plasma display panel of claim 1, wherein the first electrodes and second electrodes comprise a metal material.

6. The plasma display panel of claim 1, wherein a dielectric layer is formed on outer surfaces of the first electrodes, the second electrodes, and the address electrodes.

7. The plasma display panel of claim 6, wherein a protection layer is formed on an outer surface of the dielectric layer.

8. The plasma display panel of claim 1, wherein each of the protrusions of the second electrodes is flanked by a pair of the address electrodes, and wherein each of the protrusions of the second electrodes is formed closer to one of the pair of address electrodes.

9. The plasma display panel of claim 8, wherein a distance between each of the protrusions and one of the pair of the address electrodes is less than a distance between the each of the protrusions and the other one of the pair of address electrodes.

10. The plasma display panel of claim 1, wherein a distance between the address electrodes and the first substrate is substantially identical to a distance between the protrusions of the first electrodes and the first substrate and is substantially identical to a distance between the protrusions of the second electrodes and the first substrate.

11. The plasma display panel of claim 1, wherein a thickness of the address electrodes along a direction perpendicular to the first substrate and second substrate is greater than thicknesses of the protrusions of the first electrode and second electrode along a same direction.

12. The plasma display panel of claim 1, wherein a dielectric layer is formed between each of the address electrodes, the first electrodes, and the second electrodes and the first substrate.

13. The plasma display panel of claim 1, further comprising barrier ribs formed between the first substrate and second substrate that define the discharge cells.

14. The plasma display panel of claim 13, wherein the barrier ribs include first barrier rib members formed along the first direction, and second barrier rib members formed along a second direction to intersect the first barrier rib members.

15. The plasma display panel of claim 13, wherein the barrier ribs include first barrier rib members formed along the first direction.

16. The plasma display panel of claim 1, wherein the phosphor layers are formed in the discharge cells on the second substrate.

17. The plasma display panel of claim 1, wherein black layers are formed adjacent to the second substrate and correspond to a planar pattern of the address electrodes, the first electrodes, and the second electrodes.

18. The plasma display panel of claim 17, wherein the black layers are formed between the second substrate and the phosphor layers.

19. The plasma display panel of claim 1, wherein a pair of one of the first electrodes and one of the second electrodes is provided for each row of the discharge cells arranged along the second direction, wherein a sustain pulse is applied to the first electrodes during a during a discharge sustain interval and a scan pulse is applied to the second electrodes during an address interval, wherein the first and second electrodes are alternatingly provided along the first direction such that a repeating arrangement of one of the first electrodes and one of the second electrodes occurs along the first direction.

20. The plasma display panel of claim 1, wherein a pair of one of the first electrodes and one of the second electrodes is provided for each row of the discharge cells arranged along the second direction, wherein a sustain pulse is applied to the first electrodes during a during a discharge sustain interval and a scan pulse is applied to the second electrodes during an address interval, wherein an alternating arrangement comprised of one of the first electrodes, then one of the second electrodes, and then one of the second electrodes, and one of the first electrodes occurs along the first direction.

* * * * *